United States Patent [19]

Hammond

[11] Patent Number: 4,919,274

[45] Date of Patent: Apr. 24, 1990

[54] APPARATUS AND METHOD FOR HANDLING RETURNABLE BEVERAGE CONTAINER

[76] Inventor: Nathan J. Hammond, 885 Tanglewood, E. Lansing, Mich. 48823

[21] Appl. No.: 175,117

[22] Filed: Mar. 31, 1988

[51] Int. Cl.[5] ..... G07F 7/06; B07C 5/00

[52] U.S. Cl. ..... 209/583; 194/208; 100/902; 235/462; 235/486

[58] Field of Search ..... 194/205, 208, 209, 212, 194/202, 203, 213; 209/524, 583, 939, 930; 235/462, 464, 486; 250/223 B; 100/902

[56] References Cited

U.S. PATENT DOCUMENTS

| | | | |
|---|---|---|---|
| 2,887,204 | 5/1959 | Giuliano | 194/212 X |
| 4,245,731 | 1/1981 | Herbst et al. | 194/209 |
| 4,248,334 | 2/1981 | Hawley et al. | 194/209 |
| 4,285,426 | 8/1981 | Cahill | 194/209 |
| 4,492,295 | 1/1985 | DeWoolfson | 194/212 X |
| 4,499,824 | 2/1985 | Elwing et al. | 194/208 X |
| 4,573,641 | 3/1986 | DeWoolfson et al. | 194/205 X |
| 4,653,627 | 3/1987 | Hampson et al. | 194/209 |
| 4,717,026 | 1/1988 | Fischer et al. | 194/205 X |

FOREIGN PATENT DOCUMENTS

| | | | |
|---|---|---|---|
| 2102174 | 1/1983 | United Kingdom | 194/208 |

*Primary Examiner*—Kevin P. Shaver
*Assistant Examiner*—Edward S. Ammeen
*Attorney, Agent, or Firm*—Reising, Ethington, Barnard, Perry & Milton

[57] ABSTRACT

An apparatus (10) for separating returnable beverage containers from non-returnable beverage containers includes a V-shaped receptacle (20) for receiving the container (C), an access door (36) and an exit door (38). A downwardly sloping ramp (56) guides the container (C) from the receptacle (20) to a pair of rollers (52, 54) for rotating the container (C). First (60) and second (62) panels extend laterally outwardly and upwardly of the rollers (52, 54) for continuously guiding the container (C) back onto the rollers (52, 54) during rotation. A sweeper arm (70) moves in a path above the rollers (52, 54) to eject the container (C) rearwardly toward a pair of deflection gates (78, 79) for directing the container (C) to either an accept station (64) where the container (C) is crushed or a reject station (66) where the container (C) is returned to the operator.

46 Claims, 5 Drawing Sheets

APPARATUS AND METHOD FOR HANDLING RETURNABLE BEVERAGE CONTAINER

TECHNICAL FIELD

The subject invention relates to an apparatus and method for separating returnable beverage containers from non-returnable beverage containers.

BACKGROUND ART

Apparatus for separating returnable beverage containers from non-returnable beverage containers are well known in the prior art. These prior art apparatus commonly perform the basic operations of receiving a beverage container to be separated, ascertaining the origin of the container by identifying some type of code thereon, accepting properly returnable containers, and rejecting non-returnable containers.

One example of a prior art beverage container separating apparatus is shown in the U.S. Pat. No. 4,248,334 to Hanley et al, issued Feb. 3, 1981. The Hanley container separating apparatus includes a compartment for uprightly receiving a beverage container onto a rotating turntable. A stationary optical sensing device scans the beverage container for a UPC (Universal Products Code) code as the container rotates on the turntable. The Hanley apparatus is deficient in several respects. Firstly, the code identifying operation is preformed in the compartment where the container is received from the operator, thus making the code identifying area vulnerable to a thief attempting to fraudulently receive a refund for the deposit price of the beverage container, such as by fastening a representative UPC code on the end of a stick and waving it in the scanning path of the optical sensing device. Secondly, because the beverage container is placed upright on the turntable, the centrifugal forces acting on a rotating body will have the effect of unbalancing and upsetting the container should it be improperly positioned, i.e., not centrally placed, on the turntable. Thirdly, the Hanley apparatus may prove unsafe for public use as the turntable and certain other moving parts are located in a position accessible to the hand of an operator.

Another example of a prior art container separating apparatus is shown in the U.S. Pat. No. 4,285,426 to Cahill, issued Aug. 25, 1981. The Cahill apparatus includes a carousel having a plurality of circumferentially spaced container receptacle compartments for transporting the container from a receiving position to a position for identifying a UPC code on the container. The Cahill apparatus is deficient, firstly, in that, because the containers are placed in the receptacle compartments of the carousel in an upright posture, the carousel can not be rapidly rotated to a position for code identification because of the centrifugal forces tending to upset the container in a radially outward direction. This frustrates the identification of the code thereon with the stationary optical sensing device. In other words, the carousel type receptacle prevents rapid processing of a plurality of containers. Secondly, the Cahill apparatus requires that the beverage container be manually positioned in the receptacle compartment with the code facing in an outward direction. It will be appreciated that this requirement fails to consider the possibility that an operator may be of extraordinarily low mechanical aptitude or be incapable of understanding such complicated instructions, thus making it impossible for such a person to obtain a refund. Thirdly, the partitions dividing adjacent receptacle compartments are capable of pinching the fingers of an operator as the carousel rotates, thus making the Cahill apparatus unsafe for the public at large.

Yet another prior art container separating apparatus is shown in the U.S. Pat. No. 4,573,641 to DeWoolfson et al, issued Mar. 4, 1986. The DeWoolfson separating apparatus includes a V-shaped receiving tray onto which an operator places a glass beverage container. The V-shaped receiving tray motionlessly supports the container while a stationary optical sensing device identifies the code on the container. Once the container code has been identified, and depending upon the color of the glass container, one of the two panels forming the V-shaped receiving tray rotate downwardly allowing the beverage container to roll into one of two crushing wheels. The DeWoolfson container separating apparatus is deficient, firstly, in that direct access to the code identification area is available to an operator, thereby inefficiently protecting against the above-stated problem of theft from a fraudulent attempt to collect a refund. Secondly, the container must be manually positioned in the V-shaped receiving tray so that the code faces in a direction for proper identification by the stationary optical sensing device. As stated above, an operator of low mechanical aptitude or low comprehension capacity may be unable to obtain a deserved refund for a properly returnable beverage container. Thirdly, it will be appreciated than an operator may inadvertently place his fingers between two relatively moving parts in the receiving tray area, thereby rendering the DeWoolfson container separating apparatus unsafe for use by the public at large.

A further example of a prior art container separating apparatus is one marketed by Metropolitan Mining Company, Inc., 510 Old Bridge Turnpike, South River, N.J. 08882. The Metropolitan Mining apparatus includes a tubular container receiving chute having two feed wheels biased into the center of the chute for engaging and propelling an inserted container through the feed chute and into a code identification area including a roller system having four parallel rollers arranged in cage fashion. After a stationary optical sensing device has ascertained the UPC code on the container, the cage is rotationally indexed 90° in either direction by a Geneva gear system driven by a stepping motor for directing, i.e., tipping, the container to either a reject chute or a crushing drum. This prior art system is deficient, firstly, in that the feed wheels biased into the receiving chute do not efficiently propel both large, e.g., three liter, and small, e.g., one half liter, beverage containers through the receiving chute. Secondly, access to the code identification area is provided for an operator through the feed chute, thereby allowing a thief to fraudulently procure a refund by placing a representative container code in the path of the optical sensing device. Thirdly, testing has proven that a container has a tendency to bounce off the rollers during rotation. Thus, after bouncing off of the rollers, the container may be confiscated by the apparatus without issuing the operator his due refund. This problem is compounded when the beverage container does not have a smooth round exterior i.e., the container is dented or the like. Fourthly, the stepping motor and Geneva gear drive system are known to build up unacceptable tolerances during a plurality of successive 90° rotations of the cage, thereby improperly positioning the roller cage to receive and identify containers after a period of use.

SUMMARY OF THE INVENTION AND ADVANTAGES

The subject invention provides an apparatus for handling returnable beverage containers of the type having container identification code thereon identifying the origin of the container for separating returnable containers from non-returnable containers. The apparatus comprises receptacle means for receiving the container, and separation means responsive to the container code and spaced from the receptacle means for separating returnable containers from non-returnable containers. The subject invention is characterized by the receptacle means including isolation chamber means having an access thereto and an exit therefrom for receiving the container through the access while preventing passage from the isolation chamber mans to the separation means and for passing the container from the exit to the separation means while blocking off the access to the isolation chamber means to prevent access to the separation means through the receptacle means.

The subject invention also provides a method for handling returnable beverage containers comprising the steps of identifying the container code at a code identifying station to identify returnable containers, transferring returnable containers to an accepted station, and transferring non-returnable containers to a rejected station. The method is characterized by placing the container into an isolation chamber through an access thereto while preventing passage from the isolation chamber to the code identifying station and passing the container from an exit of the isolation chamber to the code identifying station while blocking off the access to the isolation chamber to prevent access to the code identifying station through the isolation chamber.

According to another aspect of the subject invention, an apparatus for handling returnable beverage containers is provided and comprises receptacle means for receiving the container, and separation means spaced from the receptacle means for separating returnable containers from non-returnable containers. The separation means includes code identification means responsive to the container code for identifying the origin of the container, and rotation means for rotating the container in a code identifying position adjacent the code identification means to position the container for identifying the container code thereon. The apparatus is characterized by the separation means including guide means continuously guiding the container back into the identifying position while being rotated.

The subject invention also provides a method for handling returnable containers comprising the steps of identifying the container code on the container at a code identifying station to identify returnable containers, transferring returnable containers to an accept station, transferring non-returnable containers to a reject station, and rotating the container in a code identifying position in the code identifying station to position the container for identifying the container code thereon. The method is characterized by continuously guiding the container back into the code identifying position while being rotated.

The subject invention positively prevents access to the separation means where the container code is identified so that an operator can not fraudulently procure a refund. Additionally, by including guide means for continuously guiding the container back into a code identifying position while being rotated, the possibility of the container inadvertently moving out of a code identifying position is eliminated. The subject invention also allows for rapid processing of sequentially inserted beverage containers, and is safe and simple to operate even by persons of extraordinarily low mechanical aptitude. Further, the subject invention can be easily fabricated from inexpensive materials to produce a compact and lightweight unit.

BRIEF DESCRIPTION OF THE DRAWINGS

Other advantages of the present invention will be readily appreciated as the same becomes better understood by, reference to the following detailed description when considered in connection with the accompanying drawings wherein.

DETAILED DESCRIPTION OF THE PREFERRED EMBODIMENT

The preferred embodiment illustrated in FIGS. 1–4 is particularly suited for use in separating plastic beverage containers, and more particularly plastic containers comprising a body of revolution symmetrical about a longitudinal axis thereof. That is, beverage containers C handled by the preferred embodiment of the subject apparatus 10 are circular when viewed in any cross section taken perpendicular to the container's longitudinal axis.

Referring to the Figures, wherein like numerals indicate like or corresponding parts throughout the several views, a returnable beverage container handling apparatus according to the subject invention is generally shown at 10. The returnable beverage container C is of the type having a container identification code thereon identifying the origin of the container C so that returnable containers can be separated from non-returnable containers. Preferably, the code is of the UPC type.

Figure 1:
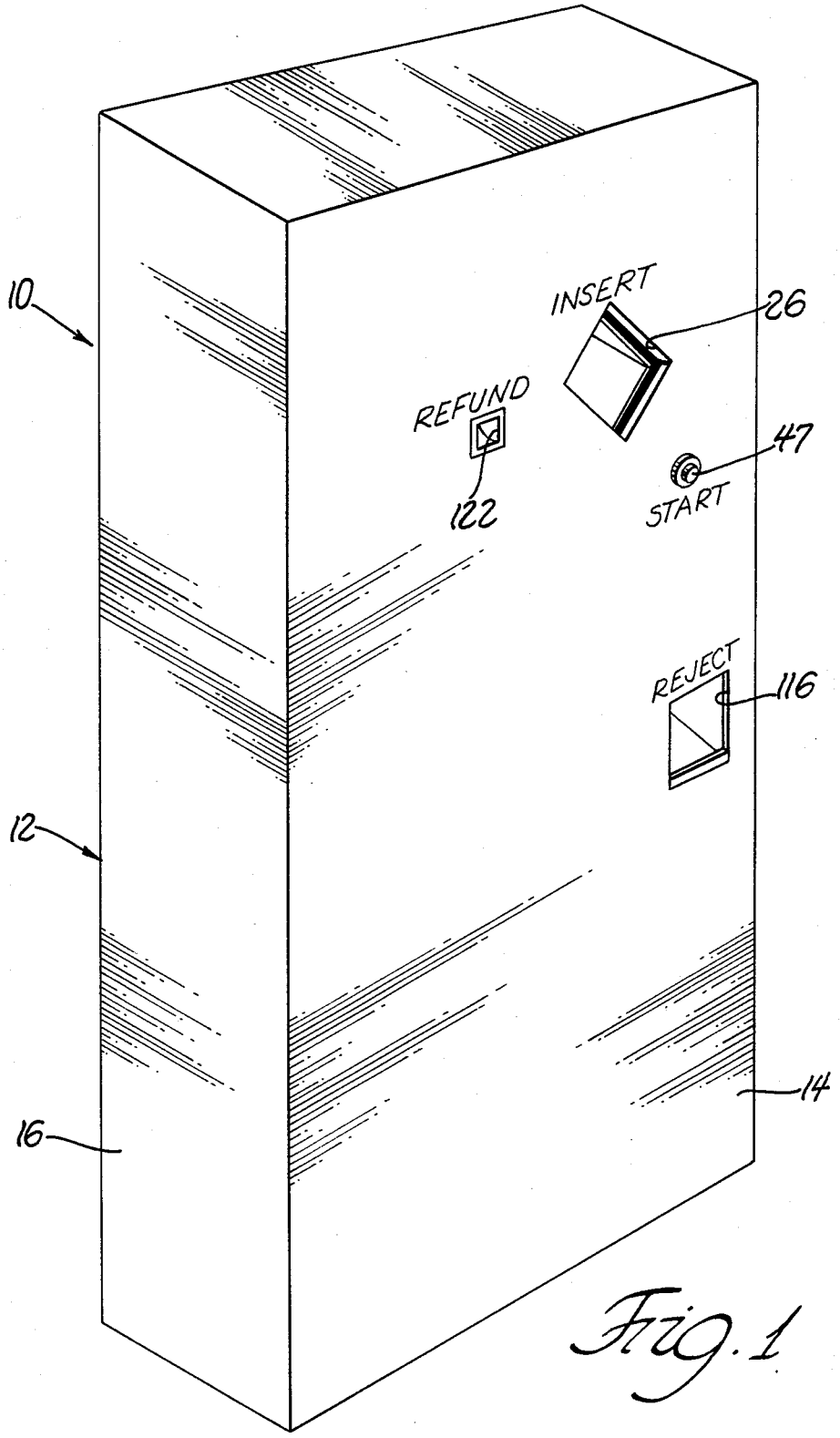
FIG. 1 is a perspective view of a preferred embodiment of the subject invention.

In FIG. 1, the subject invention 10 is shown encased within a housing, generally indicated at 12. The housing 12 includes a vertical front wall 14, a vertical left side wall 16 perpendicular to the front wall 14, and a horizontal top wall 18 perpendicular to both the front wall 14 and the left side walls 16. As will be appreciated, a back wall opposite the front wall 14, a right side wall opposite the left side wall 16, and a base opposite the top wall 18 are also provided. For purposes of security, the housing 12 should be relatively impenetrable, i.e., impervious to vandals and their tools.

Figure 2:
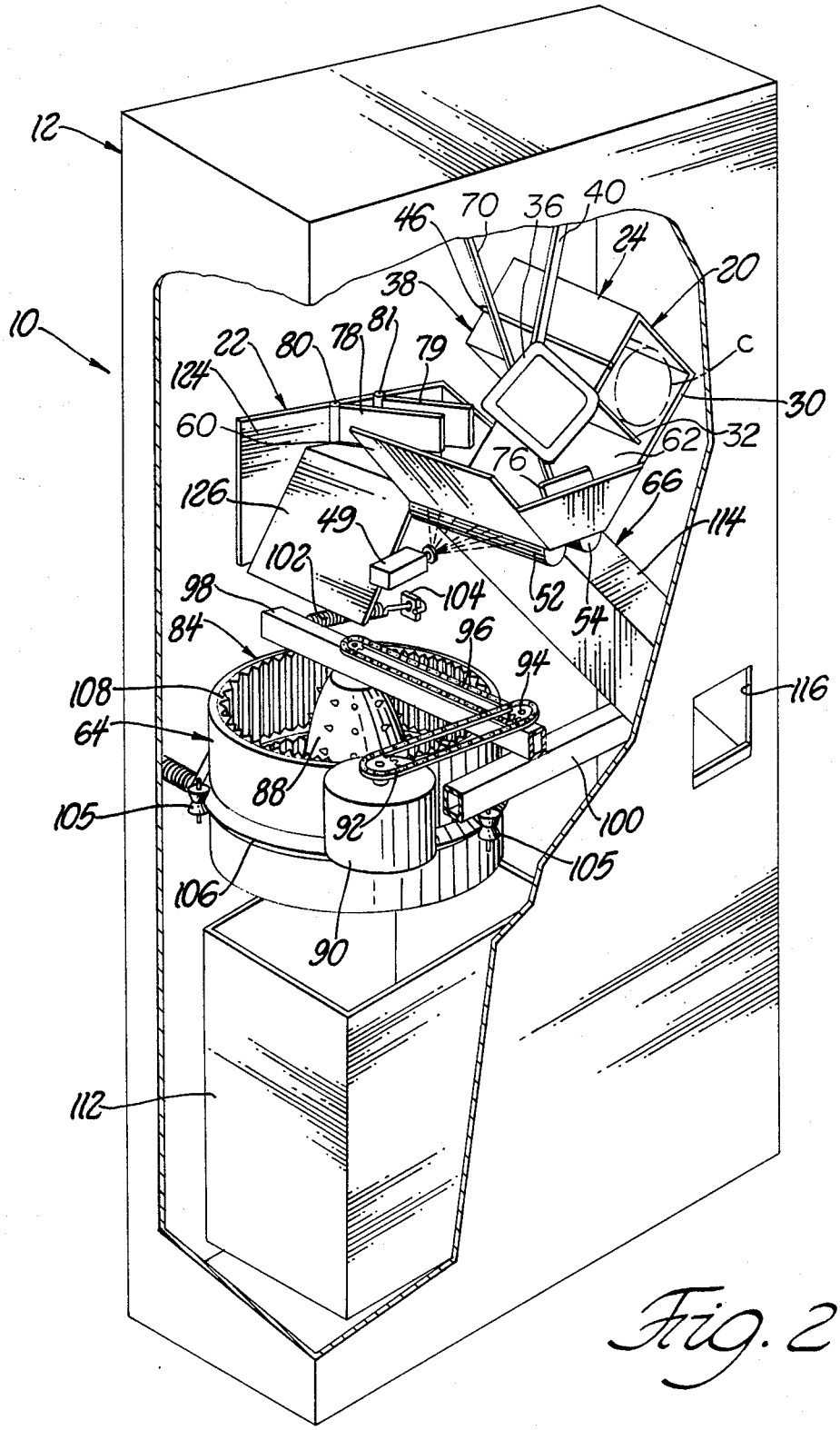
FIG. 2 is a partially cut-away view showing internal structure of the subject invention.

As shown in FIG. 2, the subject apparatus 10 comprises receptacle means, generally indicated at 20, for receiving the container C, and separation means, generally indicated at 22, responsive to the container code and spaced from the receptacle means 20 for separating returnable containers from non-returnable containers. The subject apparatus 10 is characterized by the receptacle means 20 including isolation chamber means, generally indicated at 24, having an access 26 thereto and an exit 28 therefrom for receiving the container C through the access 26 while preventing passage from the isolation chamber means 24 to the separation means 22 and for passing the container C from the exit 28 to the separation means 22 while blocking off the access 26 to the isolation chamber means 24 to prevent access to the separation means 22 through the receptacle means 20.

Figure 4:
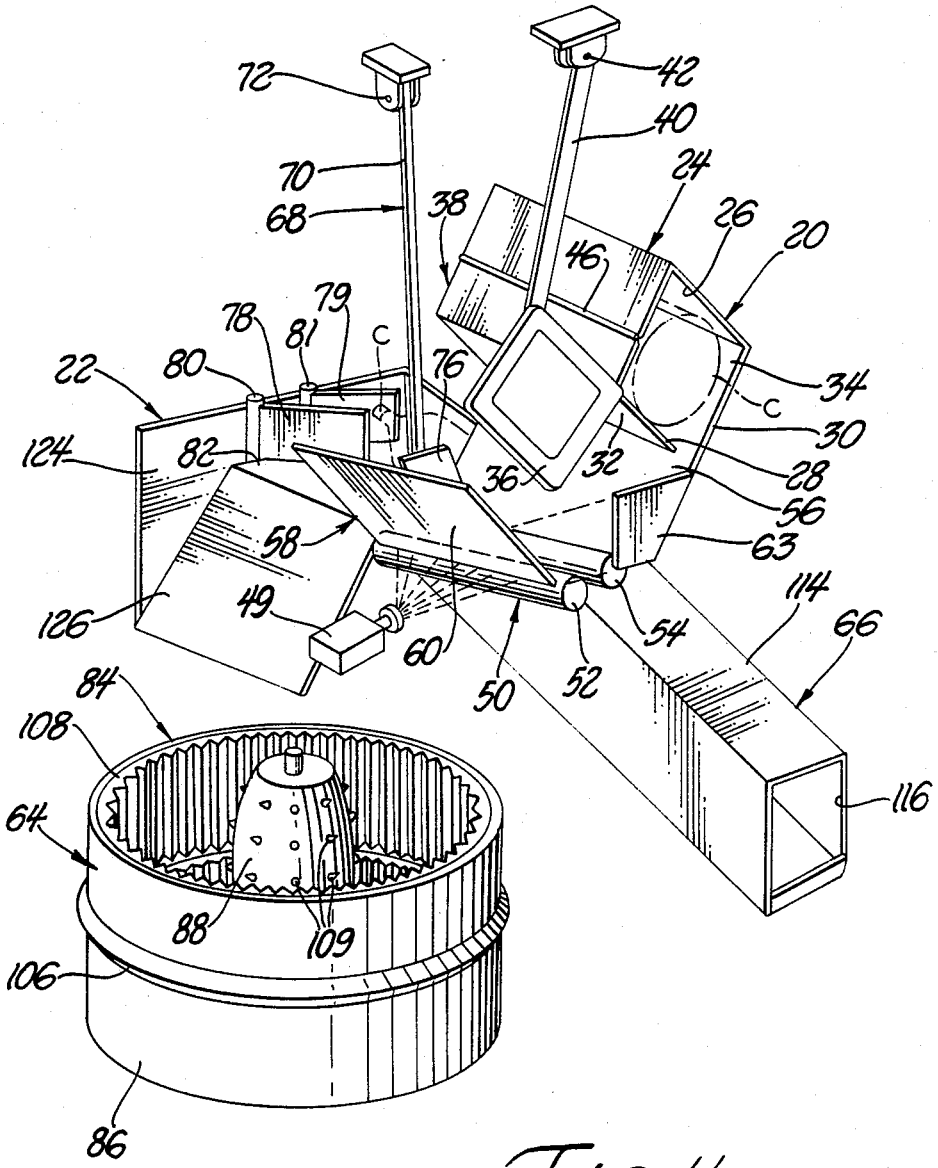
FIG. 4 is a simplified perspective view of the subject invention shown in another phase of the container operation.

As shown in FIGS. 2 and 4, the isolation chamber means 24 includes an elongated trough 30 for receiving and supporting the container C in a cradle-like position, such that the longitudinal axis of the container C is maintained in a generally horizontal position. More specifically, the trough 30 includes a first support wall 32 and a second support wall 34. The first 32 and second 34 support walls are angularly disposed in a longitudinally extending V-shape. As shown in the FIGURES, the trough 30 extends perpendicularly inwardly from the front wall 14 of the housing 12. The container C is placed in the trough 30 by the operator and remains gravitationally wedged between the first 32 and second 34 support walls until passed through the exit 28.

Figure 3:
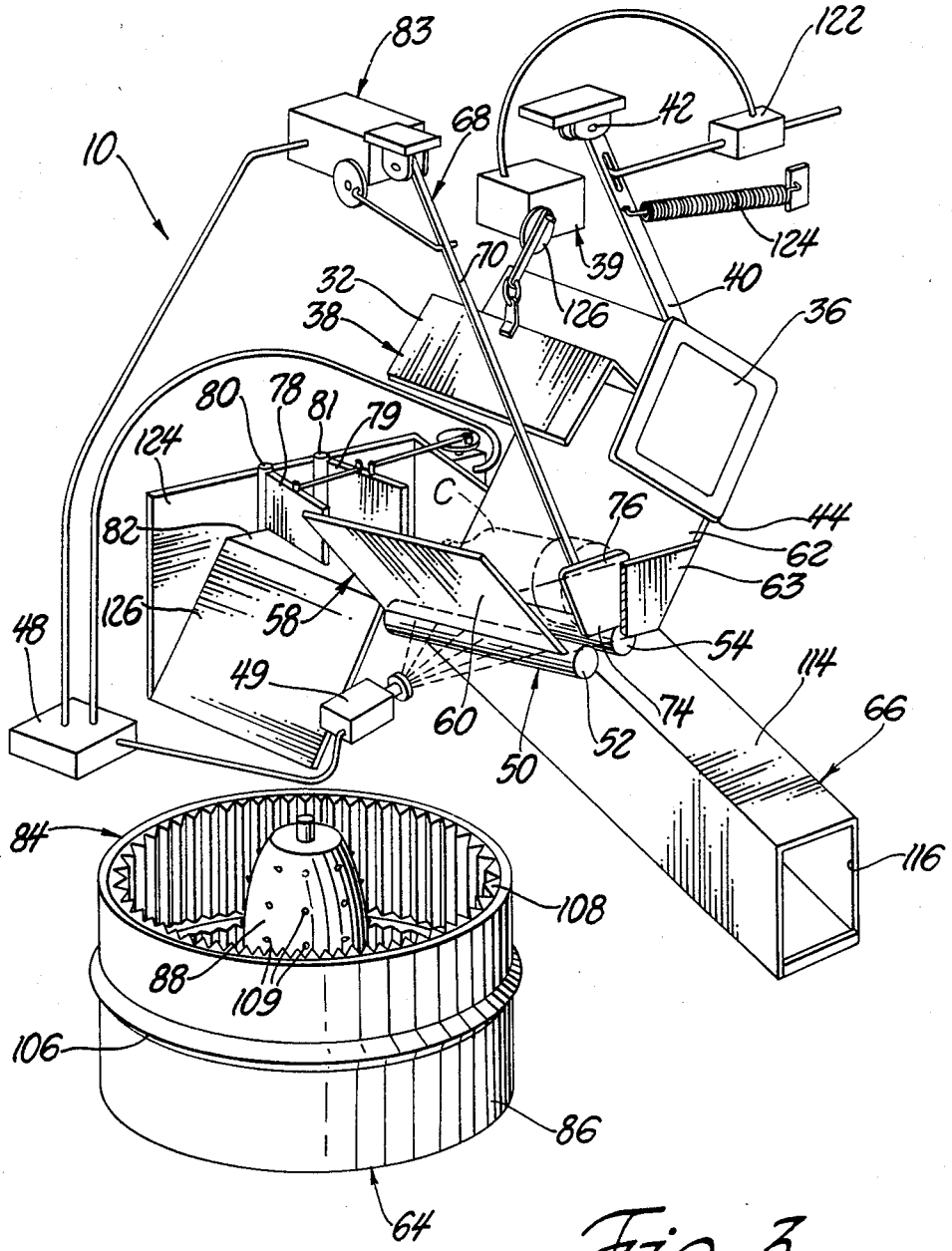
FIG. 3 is a simplified view of the subject invention shown in one phase of the container separating operation.

The isolation chamber means 24 further includes an access door 36 for closing the access 26, an exit door, generally indicated at 38, for closing the exit 28, and interlock means 39 for controlling the movement of the access door 36 and the exit door 38 to close at least one of the access door 36 or the exit door 38 at all times. More specifically, the access door 36 of the isolation chamber means 24 includes a swing arm 40 having a fixed pivot end 42 and a free swinging end 44, as shown in FIGS. 3 and 4. The portion of the access door 36 which blocks the access 26 is disposed at the free swinging end 44.

The interlock means 39 may comprise any type of electro-mechanical device. For example, the interlock means 39 is shown in FIG. 3 including a solenoid actuator 122 for urging the access door 36 open and a tension spring 124 for urging the access door 36 to block the access 26. Also, the interlock means 39 is shown including a crank wheel 126 mechanically linked to the exit door 38. As the crank wheel 126 is rotated, such as by a stepping motor or the like, the exit door 38 is urged open and closed. Of course, a microcomputer or like device will be required to govern the movements of the solenoid 122 and the crank wheel 126. It will become apparent to those skilled in the art, however, that other electro-mechanical devices may be incorporated to perform the desired functions.

The first support wall 32 is moveable relative to the second support wall 34, as shown in FIG. 3. More specifically, a hinge 46, shown in FIGS. 2 and 4, is disposed along the upper edge of the first support wall 32 for allowing the first support wall 32 to rotate away from the second support wall 34, and thus unblock the exit 28 for the container C to pass therethrough. Said another way, in the preferred embodiment the exit door 38 and the first support wall 32 are the same element, with the exit door 38 performing the function of the first support wall 32 when blocking the exit 28.

The interlock means 39 is responsive to a starting signal, such as the pushing of a start button 47 as shown in FIG. 1. As will be described with the operation of the preferred embodiment, the interlock means 39 closes the access 26 after a container C has been inserted into the isolation chamber means 24, then opens the exit 28 to allow the container C to move into the separation means 22, then recloses the exit 28 and finally reopens the access 26 to receive another container C. In this manner, an impervious barrier is continuously provided between the operator and the separation means 22 where the code identification operation is conducted, thereby preventing fraudulent practices.

The separation means 22 includes code identification means, generally indicated at 48, responsive to the container code for identifying the origin of the container C. More specifically, the code identification means 48 includes a stationary optical sensing device 49 such as that manufactured by Metro Logic. As will be more fully described subsequently, the code identification means 48 also includes a microcomputer responsive to the information received from the optical sensing device 49 for comparing the container code with stored information to determine the acceptable or rejectable nature of the container C.

The separation means 22 also includes rotation means 50, disposed adjacent the code identification means 48, for rotating the container C about the longitudinal axis thereof in a code identifying position, as shown in FIG. 3. That is to say, the optical sensing device 49 of the code identification means 48 is focussed toward the rotation means 50 for scanning across the entire length of the container C while supported in a code identifying position, as shown in FIG. 3. Therefore, the rotation means 50 define a code identifying station, i.e., a station where the container C is scanned to identify the container code thereon. The rotation means 50 includes a pair of elongated cylindrical rollers 52, 54 having parallel longitudinal axes. The rollers 52, 54 are driven to rotate axially in a common angular direction. The longitudinal axes of the rollers 52, 54 extend generally parallel of the trough 30. As shown in FIGS. 2, 3 and 4, the longitudinal axes of the rollers 52, 54 are contained within a generally horizontal plane. As shown in FIG. 3, the container C is supported between the rollers 52, 54 in a cradle-like manner and induced to rotate about its longitudinal axis in an opposite angular direction as the rollers 52, 54 by the common rotation of the rollers 52, 54. In this manner, the pair of rollers 52, 54 rotate the container C in order that the stationary optical sensing device 49 of the code identification means 48 can respond to, or read, the container code with each transit across the scanning path of the optical sensing device 49.

The separation means 22 further includes passage means 56 extending between the isolation chamber means 24 and the rotation means 50 for guiding the container C from the isolation chamber means 24 to the rotation means 50. As shown in FIGS. 2, 3 and 4, the passage means 56 includes a sloping ramp 56 extending from the trough 30 downwardly to the rotation means 50.

According to another characterizing feature of the subject invention 10, the separation means 22 includes guide means 58 associated with the rotation means 50 for continuously guiding the container C back into the code identifying position during rotation of the container C. More specifically, as shown in FIGS. 3 and 4, the guide means 58 includes a first panel 60 extending laterally outwardly and upwardly from one of the rollers 52 and a second panel 62 extending laterally outwardly and upwardly of the other roller 54. That is to say, the first 60 and second 62 panels of the guide means 58 are arranged in a V-shape, with the rollers 52, 54 disposed at the bottom of the V-shape for cradling the container C during rotation thereof. In the accompanying FIGURES, the first 60 and second 62 panels are shown as being planar, however it will be appreciated that a curvature may be imparted to either or both panels 60, 62. An end plate 63 is disposed at one end of the guide means 58, and extends between the first 60 and second 62 panels. The end of the guide means 58 opposite the end plate 63 is open, for reasons to be described subsequently.

In the event that the particular container C being rotated includes a dented or otherwise nonsmooth exterior surface, wherein rotation would ordinarily cause the container C to bounce out of the code identifying position, the inwardly angling first 60 and second 62 panels continuously guide, by gravitation, the container C back into the code identifying position. The second panel 62 of the guide means 58 is coincidental with the passage means 56. That is, the passage means 56 and the second panel 62 are composed of the same member. More specifically, the second wall 34 of the trough 30 is an integral planar extension of the second panel 62 of the guide means 58, with the passage means 56 merely comprising an inclusive portion between the second wall 34 and second panel 62.

The separation means 22 further includes an accept station, generally indicated at 64, for receiving returnable containers, a reject station, generally indicated at 66, for receiving non-returnable containers, and ejection means, generally indicated at 68, responsive to the code identification means 48 for transferring the container C from the rotation means 50 to either the accept station 64 or the reject station 66.

The ejection means 68 includes a sweeper arm 70 having a fixed pivot end 72 and a free sweeping end 74. A plate-like paddle 76 is disposed on the sweeping end 74. During a container C ejection process, the paddle 76 is urged to sweep an arcuate path between the first 60 and second 62 panels of the guide means 58, adjacent the pair of rollers 52, 54. That is to say, the paddle 76 moves in an arcuate path slightly above and centered between the pair of rollers 52, 54, as shown in FIG. 4. Prior to ejecting a container C, however, the paddle 76 is positioned adjacent the end plate 63, and sweeps its arc away from the end plate 63 to move the container C rearwardly out of the code identifying station.

The ejection means 68 also includes a pair of deflection gates 78,79 responsive to the code identification means 48 and movable between an accept position, as shown in FIG. 2, for guiding a returnable container toward the accept station 64, and a reject position, as shown in FIGS. 3 and 4, for guiding a non-returnable container toward the reject station 68. More specifically, the gates 78, 79 are maintained generally parallel of each other and extend from vertical pivotal axes 80, 81, respectively, toward the pair of rollers 52, 54. A horizontal ledge 82 extends rearwardly of the rollers 52, 54 and is disposed immediately under the gate 78. As will be described subsequently, the ledge 82 supports the container C as the container C is ejected from the code identifying position by the paddle 76.

The ejection means 68 further includes an electro-mechanical operating system, generally indicated at 83 in FIG. 3, for moving the sweeper arm 70 and the gates 78, 79 in the proper directions at the proper times. For example, the electro-mechanical system may include a gear wheel mechanically linked to the parallel gates 78, 79. A gear wheel driven by a stepping motor may also induce the required movements of the sweeper arm 70. Of course, a microcomputer or like device would be required to govern the movements of the control system 83. It will become apparent to those skilled in the art that other electro-mechanical arrangements than those illustrated may be adequately utilized in carrying out the necessary functions.

The accept station 64 includes crushing means, generally indicated at 84, for crushing returnable containers. More specifically, the crushing means 84 includes an outer drum 86 and a barrel-shaped crushing wheel 88 driven to rotate within the outer drum 86. As shown in FIG. 2, a motor 90 drives the crushing wheel 88 to rotate within the outer drum 86. A continuous drive chain 92 is driven by the motor 90 to turn an idler cog 94, which in turn drives a continuous driven chain 96 disposed about a portion of the crushing wheel 88. Both the idler cog 94 and the crushing wheel 88 are rotatablly disposed on a tubular cross bar 98. The cross bar 98 is pivotally attached to a structural support element 100 within the housing 12 of the subject invention 10. The end of the cross bar 98, distal the pivotal connection at the structural support element 100, is free to swing in a horizontal arcuate path. An extension spring 102 is anchored at one end to a tab 104 extending from the back wall of the housing 12 and at the other end to the free swinging end of the cross bar 98 for urging the cross bar 98 and the attached crushing wheel 88 toward the inner surface of the drum 86.

The drum 86 is rotationally supported by three rollers 105, as shown in FIG. 2. Preferably, one of the three rollers 105 is biased inwardly to hold the drum 86 against the other two fixed rollers 105. As perhaps best shown in FIG. 5, the rollers 105 are hour-glass shaped for engaging a triangular urethane guide ring 106 disposed about the periphery of the drum 86. The guide ring 106 is cast in a mold about a chord-like anchor 107 welded to the outer surface of the drum 86. In this manner, the drum 86 is rotated while a central axis of rotation thereof is held in a fixed position.

Figure 5:
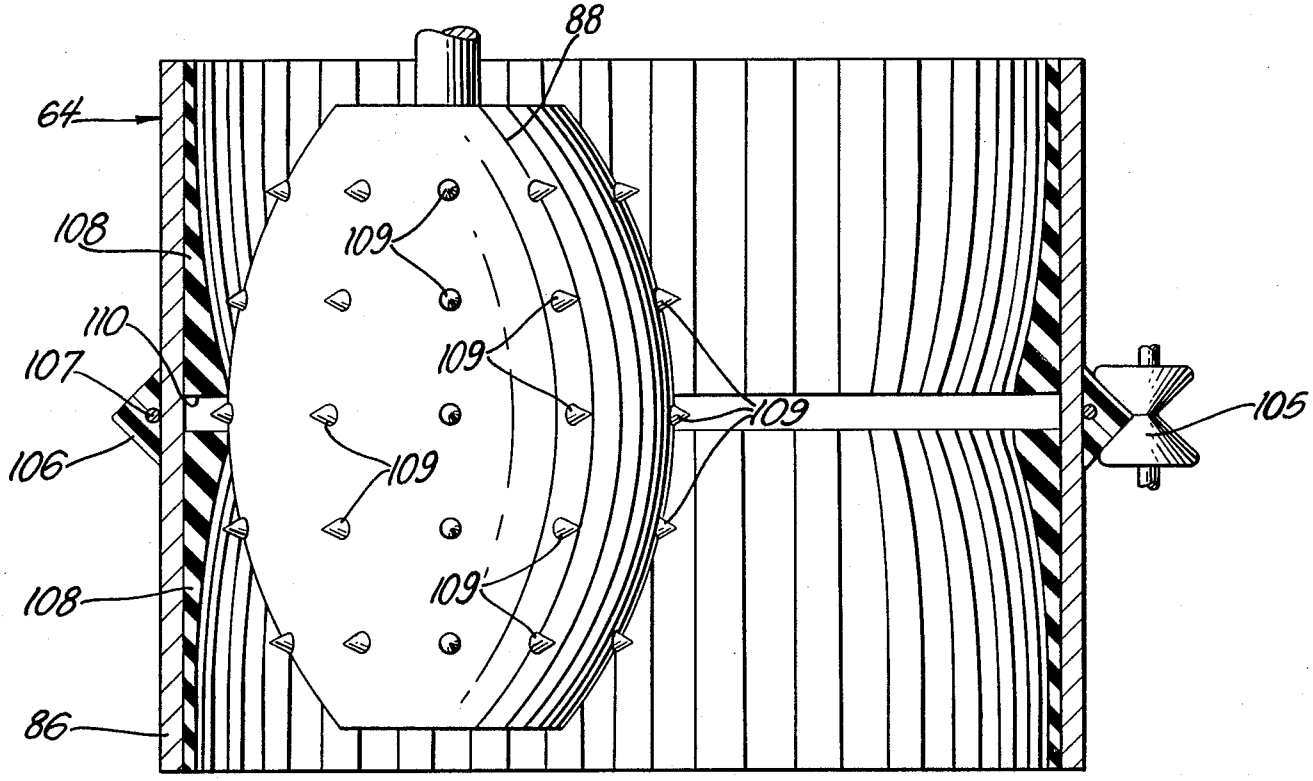
FIG. 5 is a cross sectional view of the crushing means.

As shown in FIGS. 2, 3, 4 and 5, the inner surface of the drum 86 is lined with a resilient corrugated material 108. The outer surface of the crushing wheel 88 includes a plurality of spike-like studs 109 for seizing and puncturing the container C during the crushing operation. As shown in FIG. 5, The corrugated lining 108 of the drum 86 has a gradually increasing thickness toward the mid portion of the drum 86. A channel 110 is provided in the middle of the corrugated lining 108 so that an equatorial row of studs 109 on the crushing wheel 88 do not contact, and hence damage, the resilient corrugated lining 108 during rotation.

As best seen in FIG. 5, the corrugated lining 108 contacts the outer surface of the crushing wheel 88 at positions adjacent the channel 110. In this manner, as the crushing wheel 88 is induced to rotate by the motor 90, the drum 86 is frictionally driven to rotate within the support rollers 105.

A storage bin 112 is positioned beneath the crushing means 84 for collecting crushed returnable containers, as shown in FIG. 2.

The reject station 66 includes a reject passage 114 for gravitationally guiding the container C to a position exterior of the subject apparatus 10. As shown in FIGS. 2, 3 and 4, the reject passage 114 includes a tubular passage having an opening adjacent the gates 78, 79 for receiving a non-returnable container ejected from the code identifying station. The reject passage 114 extends downwardly to an opening 116 disposed in the front wall 14 of the housing 12, for presenting a non-returnable container to the operator.

OPERATION OF THE PREFERRED EMBODIMENT

In operation, a beverage container C is passed, either end first, through the access 26 and into the trough 30. As the container C is cradled between the first 32 and second 34 support walls, the operator signals the apparatus 10 to begin the separation process by pushing the start button 47. In response to actuation of the start button 47, the interlock means 39 signals the access door 36 to swing into a fully closed position, completely covering the access 26 to the isolation chamber means 24, as shown in FIG. 3. Magnetic proximity switches, or the like, sense when the access door 36 is in the fully closed position and then send a signal back to the interlock means 39 relaying this information. Upon receiving the signal that the access door 36 is in its fully closed position, the interlock means 39 signals the exit door 38 to rotate open, thus allowing the container C to roll down the ramp 56 and onto the rollers 52, 54. Once the container C has passed through the exit 28, the exit door 38 is signalled by the interlock means 39 to return to its closed position. Next, the interlock means 39 signals the access door 36 to swing away from the access 26, thus allowing insertion of another container C.

In the event the container C or some other object obstructs complete closure of the access door 36, the magnetic proximity switches will not signal the interlocking means 39 to open the exit door 38. In this manner, an operator attempting to fraudulently obtain an undeserved refund cannot gain access to the code identification means 48. Also, it should be here noted that the swinging access door 36 is very light weight and swings gently into the fully closed position. Therefore, if an operator's fingers are extended through the access 26 after the start button 47 is actuated, the light weight access door 36 will merely contact the operator's fingers and stop, without causing injury thereto. To further safeguard an operator from injury occurring in this manner, the peripheral edge of the access door 36 may be covered with a soft rubber material.

Once positioned on the rollers 52, 54, the container C is rotated, allowing the optical sensing device 49 of the code identification means 48 to scan the rotating container until the container code crosses the scanning path. At this, the code identification means 48 compares the information from the container code with data stored in the memory of the microcomputer to determine whether the container C is returnable or non-returnable.

If the container C is properly returnable, the code identification means 48 accrues a debit to the distributor of the container C and issues a refund to the operator for the deposit price of the container C. This refund emerges from a refund slot 122, shown in FIG. 1, and may take the form of either a redeemable coupon or cash. The gates 78, 79 are always positioned in the accept position, as shown in FIG. 2, before the container code is identified. Therefore, no movement of the gates 78, 79 is necessary when the container is properly returnable. The sweeper arm 70 next urges the paddle 76 to expel the container C rearwardly from the code identifying position onto the ledge 82 and against the one gate 78. The container C then moves against a back wall 124 and down an inclined surface 126, thereby directing the container C into the crushing means 84. Once in the crushing means 84, the container C is seised by the crushing wheel 88 and forcibly wedged between the rotating drum 86 and crushing wheel 88. The spring 102 allows the crushing wheel 88 to move away from the inner surface of the drum 86 as the container C is wedged between the two. After passing between the drum 86 and crushing wheel 88, the crushed container C drops through the bottom of the drum 86 and is collected in the storage bin 112.

If, on the other hand, the code identification means 48 recognizes the container C as being non-returnable, the gates 78, 79 are signaled to move so that the open space between the two parallel gates 78, 79 can receive the non-returnable container C from the code identifying position. That is, both gates 78, 79 are moved to extend straight toward the rollers 52, 54 so that the ejected container may be inserted between them. The sweep arm 70 then urges the container C rearwardly from the code identifying position, onto the ledge 82, and between the two gates 78, 79. Next, the gates 78, 79 are urged to move in unison toward the reject position, as shown in FIG. 3. During this movement of the gates 78, 79 toward the reject position, the non-returnable container gravitationally falls off the ledge 82 and is directed into the reject passage 114. After gravitationally travelling down the reject passage 114, the container C finally emerges through the opening 116 for return to the operator.

It will be appreciated from the foregoing description that the subject container separation apparatus 10 is extremely simple to operate, even by persons of low mechanical aptitude, as the container C is inserted into the receptacle means 20 without regard to the orientation of the code thereon. Also, the guide means 58 prevent loss of the container C within the apparatus 10 without depriving the operator his due refund. Additionally, the interlocking, i.e., alternately closing, access door 36 and exit door 38 positively prevent access to the code identification means 48 through the access 26, thus negating the possibility of an operator fraudulently receiving an undeserved refund and the possibility of injury to the operator. Further, the combination of elements in the subject apparatus 10 allow a plurality of sequentially inserted containers C to be rapidly handled, thereby requiring less of the operator's time than the prior art container separating apparatus.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An apparatus (10) for handling returnable beverage containers (C) of the type having a container identification code thereon identifying the origin of the container (C) for separating returnable containers from non-returnable containers, said apparatus (10) comprising: receptacle means (20) for receiving the container (C); and separation means (22) responsive to the container code and spaced from said receptacle means (20) for separating returnable containers from non-returnable containers; said apparatus (10) characterized by said receptacle means (20) including isolation chamber means (24) having an access (26) thereto and an exit (28) therefrom, said isolation chamber means comprises means for blocking off said separation means (22) from said isolation chamber means (24) and then for simultaneously blocking off said access (26) to said isolation chamber means (24) while receiving the container (C) through said access (26) and said separation means (22) from said isolation chamber means (24) and then for passing the container (C) from said exit (28) to said separation means (22) while blocking off said access (26) to said isolation chamber means (24) to continuously prevent access to said separation means (22) through said receptacle means (20).

2. An apparatus (10) as set forth in claim 1 further characterized by said means comprised in said isolation chamber means (24) including an access door (36) for closing said access (26), an exit door (38) for closing said exit (38), and interlock means (39) for controlling the movement of said access door (36) and said exit door (38) to close at least one of said access door (36) or said exit door (38) at all times.

3. An apparatus (10) as set forth in claim 2 wherein the container (C) comprises a body of revolution symmetrical about a longitudinal axis thereof, further characterized by said isolation chamber means (24) including an elongated trough (30) for receiving and supporting the container (C) in a cradle-like position with the longitudinal axis thereof in a generally horizontal position.

4. An apparatus (10) as set forth in claim 3 further characterized by said trough (30) including first (32) and second (34) support walls angularly disposed in a longitudinally extending V-shape, said first support wall (32) including said exit door (38).

5. An apparatus (10) as set forth in claim 4 further characterized by said first support wall (32) being moveable relative to said second support wall (34).

6. An apparatus (10) as set forth in claim 5 further characterized by said separation means (22) including code identification means (48) responsive to the container code for identifying the origin of the container (C), and rotation means (50) associated with said code identification means (48) for rotating the container (C) about the longitudinal axis thereof in a code identifying position.

7. An apparatus (10) as set forth in claim 6 further characterized by said separation means (22) including passage means (56) extending between said isolation chamber means (24) and said rotation means (50) for guiding the container (C) from said isolation chamber means (24) to said rotation means (50).

8. An apparatus (10) as set forth in claim 7 further characterized by said passage means (56) including a sloping ramp (56) extending from said trough (30) downwardly to said rotation means (50).

9. An apparatus (10) as set forth in claim 8 further characterized by said separation means (22) including guide means (58) associated with said rotation means (50) for continuously guiding the container (C) back into said code identifying position during rotation thereof.

10. An apparatus (10) as set forth in claim 9 further characterized by said rotation means (50) including a pair of elongated cylindrical rollers (52,54) having respective parallel longitudinal axes, each of said rollers (52,54) being driven to rotate axially in a common angular direction.

11. An apparatus (10) as set forth in claim 10 further characterized by said longitudinal axes of said pair of rollers (52,54) extending generally parallel of said trough (30) of said receptacle means (20).

12. An apparatus (10) as set forth in claim 11 further characterized by said longitudinal axes of each of said pair of rollers (52,54) being contained within a generally horizontal plane.

13. An apparatus (10) as set forth in claim 12 further characterized by said guide means (58) including a first panel (60) extending laterally outwardly and upwardly of one of said rollers (52) and a second panel (62) extending laterally outwardly and upwardly of the other of said rollers (54).

14. An apparatus (10) as set forth in claim 13 further characterized by said second panel (62) of said guide means (58) being coincidental with said passage means (56).

15. An apparatus (10) as set forth in claim 14 further characterized by said second wall (34) of said isolation chamber means (24) being an integral extension of said second panel (62) of said guide means (58).

16. An apparatus (10) as set forth in claim 14 further characterized by said separation means (22) including an accept station (64) for receiving returnable containers, a reject station (66) for receiving non-returnable containers, and ejection means (68) responsive to said code identification means (48) for transferring the container (C) from said rotation means (50) to either said accept station (64) or said reject station (66).

17. An apparatus (10) as set forth in claim 16 further characterized by said ejection means (66) including a sweeper arm (70) having a fixed pivot end (72) and a free sweeping end (74), said sweeping end (74) moveable in an arcuate path between said first (60) and second (62) panels of said guide means (58) and adjacent said pair of rollers (52,54).

18. An apparatus (10) as set forth in claim 17 further characterized by said ejection means (68) including a deflection gate (78) responsive to said code identification means (48) and moveable between an accept position for guiding the container (C) toward said accept station (64) and a reject position for guiding the container (C) toward said reject station (66).

19. An apparatus (10) as set forth in claim 18 further characterized by said code identification means (48) including an optical sensing device (49).

20. An apparatus (10) as set forth in claim 19 further characterized by said access door (36) of said isolation chamber means (24) including a swing arm (40) having a fixed pivot end (42) and a free swinging end (44), said access door (36) disposed at said swinging end (44).

21. An apparatus (10) as set forth in claim 20 further characterized by said accept station (64) including crushing means (84) for crushing returnable containers.

22. An apparatus (10) as set forth in claim 21 further characterized by said crushing means (84) including an outer drum (86) and a crushing wheel (88) driven to rotate within said outer drum (86).

23. An apparatus (10) as set forth in claim 22 further characterized by said reject station (66) including a reject passage (114) for gravitationally guiding the container (C) to a position exterior of said apparatus (10).

24. A method for handling returnable beverage containers (C) of the type having a container identification code thereon identifying the origin of the container (C)

for separating returnable containers from non-returnable containers, said method comprising the steps of: identifying the container code at a code identifying station to identify returnable containers; transferring returnable containers to an accept station (64); transferring non-returnable containers to a reject station (66); said method characterized by placing the container into an isolation chamber (24) through an access (26) thereto while blocking off the code identifying station from the isolation chamber (24) and then blocking off the access (26) to the isolation chamber (24) while continuing to block off the code identifying station from the isolation chamber (24) and then passing the container (C) from an exit (28) of the isolation chamber (24) to the code identifying station while blocking off the access (26) to the isolation chamber (24) to continuously prevent access to the code identifying station through the isolation chamber (24).

25. A method as set forth in claim 24 wherein the isolation chamber (24) includes an access door (36) for closing the access (26) and an exit door (38) for closing the exit (28), said method further characterized by controlling the movement of the access (36) and exit (38) doors so that at least one of the access (36) or exit (38) doors is closed at all times.

26. An apparatus (10) for handling returnable beverage containers (C) of the type having a container identification code thereon identifying the origin of the container (C) for separating returnable containers from non-returnable containers, said apparatus (10) comprising: receptacle means (20) for receiving the container (C); and separation means (22) spaced from said receptacle means (20) for separating returnable containers from non-returnable containers, said separation means (22) including code identification means (48) responsive to the container code for identifying the origin of the container (C), and rotation means (50) for rotating the container (C) in a code identifying position adjacent said code identification means (48) to position the container (C) for identifying the container code thereon, said rotation means (50) including at least two elongated cylindrical rollers (52, 54) supported for rotation about respective parallel axes fixed relative to said code identification means (48); said apparatus (10) characterized by said separation means (22) including a first panel (60) fixed relative to said code identification means (48) and extending laterally outwardly and upwardly of one of said rollers (52) and a second panel (62) fixed relative to said first panel (60) and extending laterally outwardly and upwardly of the other of said rollers (54) for continuously guiding the container (C) back into said code identifying position while being rotated.

27. An apparatus (10) as set forth in claim 26 further characterized by said separation means (22) including passage means (56) extending between said receptacle means (20) and said rotation means (50) for guiding the container (C) from said receptacle means (20) to said rotation means (50).

28. An apparatus (10) as set forth in claim 27 further characterized by said second panel (62) of said guide means (58) being coincidental with said passage means (56).

29. An apparatus (10) as set forth in claim 28 further characterized by said receptacle means (20) including isolation chamber means (24) having an access (26) thereto and an exit (28) therefrom for receiving the container (C) through said access (26) while preventing passage from said isolation chamber means (24) to said separation means (22) and for passing the container (C) from said exit (28) to said separation means (22) while blocking off the access to said isolation chamber means (24) to prevent access to said separation means (22) through said receptacle means (20).

30. An apparatus (10) as set forth in claim 29 further characterized by said isolation chamber means (24) including an access door (36) for closing said access (26), an exit door (38) for closing said exit (28), and interlock means (39) for controlling the movement of said access door (36) and said exit door (38) to close at least one of said access door (36) or said exit door (38) at all times.

31. An apparatus (10) as set forth in claim 30 wherein the container (C) comprises a body of revolution symmetrical about a longitudinal axis thereof, further characterized by said isolation chamber means (24) including an elongated trough (30) for receiving and supporting the container (C) in a cradle-like position with the longitudinal axis thereof in a generally horizontal position.

32. An apparatus (10) as set forth in claim 31 further characterized by said trough (30) including first (32) and second (34) support walls angularly disposed in a longitudinally extending V-shape, said first support wall (32) including said exit door (38).

33. An apparatus (10) as set forth in claim 32 further characterized by said first support wall (32) being moveable relative to said second support wall (34).

34. An apparatus (10) as set forth in claim 33 further characterized by said passage means (56) including a sloping ramp (56) extending from said trough (30) downwardly to said rotation means (50).

35. An apparatus (10) as set forth in claim 34 further characterized by said longitudinal axes of said pair of rollers (52,54) extending generally parallel of said trough (30) of said receptacle means (20).

36. An apparatus (10) as set forth in claim 35 further characterized by said longitudinal axes of each of said pair of rollers (52,54) being contained within a generally horizontal plane.

37. An apparatus (10) as set forth in claim 36 further characterized by said second support wall (34) of said isolation chamber means (24) being an integral extension of said second panel (62).

38. An apparatus (10) as set forth in claim 36 further characterized by said separation means (22) including an accept station (64) for receiving returnable containers, a reject station (66) for receiving non-returnable containers, and ejection means (68) responsive to said code identification means (48) for transferring the container (C) from said rotation means (50) to either said accept station (64) or said reject station (66).

39. An apparatus (10) as set forth in claim 38 further characterized by said ejection means (68) including a sweeper arm (70) having a fixed pivot end (72) and a free sweeping end (74), said sweeping end (74) moveable in an arcuate path between said first (60) and second (62) panels and adjacent said pair of rollers (52,54).

40. An apparatus (10) as set forth in claim 39 further characterized by said ejection means (68) including a deflection gate (78) responsive to said code identification means (48) and moveable between an accept position for guiding the container (C) toward said accept station (64) and a reject position for guiding the container (C) toward said reject station (66).

41. An apparatus (10) as set forth in claim 40 further characterized by said code identification means (48) including an optical sensing device (49).

42. An apparatus (10) as set forth in claim 41 further characterized by said access door (36) of said isolation chamber means (24) including a swing arm (40) having a fixed pivot end (42) and a free swinging end (44), said access door (36) disposed at said swinging end (44).

43. An apparatus (10) as set forth in claim 42 further characterized by said accept station (64) including crushing means (84) for crushing returnable containers.

44. An apparatus (10) as set forth in claim 43 further characterized by said crushing means (84) including an outer drum (86) and a crushing wheel (88) driven to rotate within said outer drum (86).

45. An apparatus (10) as set forth in claim 44 further characterized by said reject station (66) including a reject passage (114) for gravitationally guiding the container (C) to a position exterior of said apparatus (10).

46. An apparatus (10) for handling returnable beverage containers (C) of the type having a container identification code thereon identifying the origin of the container (C) for separating returnable containers from non-returnable containers, said apparatus (10) comprising: a trough (30) having an access (26) thereto and an exit (28) therefrom and including first (32) and second (34) support walls angularly disposed in a longitudinally extending V-shape, said first support wall (32) being movable relative to said second support wall (34) toward and away from said exit (28); an access door (36) for closing said access (26) to said trough (30); a pair of elongated cylindrical rollers (52,54) having respective parallel longitudinal axes, each of said rollers (52,54) being driven to rotate axially in a common angular direction; a sloping ramp (56) coplanar with said second support wall (34) and extending downwardly therefrom adjacent said pair of rollers (52,54); a first panel (60) extending laterally outwardly of said pair of rollers (52,54) and away from said sloping ramp (56); an optical sensing device (48) disposed adjacent said pair of rollers (52,54) and responsive to the container code; a sweeper arm (70) having a fixed pivot end (72) and a free sweeping end (74), said sweeping end (74) moveable in an arcuate path between said first panel (60) and said sloping ramp (56) and adjacent said pair of rollers (52,54); an accept station (64) for receiving returnable containers; and a reject station (66) for receiving non-returnable containers.

* * * * *